US006114939A

United States Patent [19]

Wittenbreder

[11] Patent Number: 6,114,939

[45] Date of Patent: Sep. 5, 2000

[54] PLANAR STACKED LAYER INDUCTORS AND TRANSFORMERS

[75] Inventor: Ernest H. Wittenbreder, Flagstaff, Ariz.

[73] Assignee: Technical Witts, Inc., Flagstaff, Ariz.

[21] Appl. No.: 09/327,100

[22] Filed: Jun. 7, 1999

[51] Int. Cl.[7] ..... H01F 5/00

[52] U.S. Cl. ..... 336/200; 336/223; 361/782; 361/784

[58] Field of Search ..... 336/200, 223; 361/782, 784, 803, 767, 768; 29/602.1

[56] References Cited

U.S. PATENT DOCUMENTS

| | | | |
|---|---|---|---|
| 5,010,314 | 4/1991 | Estrov | 336/198 |
| 5,469,334 | 11/1995 | Balakrishnan | 361/782 |
| 5,926,083 | 7/1999 | Asaoka | 336/110 |
| 5,949,191 | 9/1999 | Cassese et al. | 315/82 |

*Primary Examiner*—Michael L. Gellner
*Assistant Examiner*—Anh Mai

[57] ABSTRACT

The magnetic circuit element structure of this invention comprises a minimum four layer stacked layer sandwich construction in which layers of printed wiring board are alternately interleaved with layers of magnetic core material. Pins or wires form a part of the structure and are provided to electrically connect printed wiring board layers to form winding turns. Specifically, the pins or wires connect the copper foil patterns on layer 1 to the copper foil patterns on layer 3. Legs made of a magnetic core material also form a part of the structure and are provided to magnetically connect the core layers 2 and 4 in order to provide a closed path for magnetic flux. In the minimal structure a first layer consisting of a printed wiring board contains half turns of copper foil in one or more printed wiring board layers. The second layer is formed of ferrite or some other ferromagnetic core material. The third layer is formed of a second printed wiring board which contains half turns of copper foil in one or more printed wiring board layers. The fourth layer is formed of ferrite or other ferromagnetic material. The magnetic circuit element structure created provides a low profile planar construction with high power density, low AC conduction losses, low volume, and low assembly costs.

4 Claims, 4 Drawing Sheets

PLANAR STACKED LAYER INDUCTORS AND TRANSFORMERS

BACKGROUND OF THE INVENTION

1. Field of the Invention

The subject invention generally pertains to magnetic circuit elements, and more specifically to power magnetic circuit elements used in high frequency switched mode power electronic converter circuits.

2. Description of Related Art

Planar transformers and inductors have been used in switched mode power converter circuits for some time. Planar magnetics offer packaging flexibility in designs where component height is limited. Planar magnetics also offer assembly advantages over machine wound magnetic components because the planar magnetics typically have their windings machine etched on a printed wiring board or similar insulating substrate and no hand soldering is required. The printed wiring board winding method results in lower labor costs and simplified assembly. The printed wiring board winding method also results in greater uniformity. Typically one layer of the printed wiring board will contain one or more turns of a winding. Using a multi-layer printed wiring board the winding segments on each layer can stand alone as a complete winding or combine with other layers in a series or parallel combination to yield the desired number of turns and the desired winding resistance for a given winding. When more than one turn is placed on a single layer the winding is wound in a spiral pattern to accomplish the desired number of turns.

In a planar magnetic circuit element the electrical conducting material is copper foil which is bonded to an insulating substrate such as a glass fiber filled epoxy. Current near the outer edge of the spiral winding creates flux perpendicular to the plane of the foil in the foil segments nearer to the center of the winding. This flux creates an eddy current that flows in a loop such that the net current towards the outside of the winding is decreased or reversed and the current towards the center of the winding is significantly increased. The AC current in the foil is forced to the edges of the foil. This problem is magnified as the number of turns increases and as the center of the winding is approached. For a copper trace on the outside perimeter of the spiral winding current is forced to the inner edge of the winding by the eddy current effects, so that the total AC current is confined to the inner edge of the trace and the AC current in the remainder of the trace is zero. For the next trace in from the outermost trace a current equal to the total AC current is forced to the outer edge, but reversed in direction. At the inner edge of this second trace in from the outer perimeter the current is in the direction expected but the magnitude is doubled. All of the AC current is confined to the inner and outer edges of the trace due to the eddy currents. For the third trace in from the outer perimeter the current at the outer edge of the trace is equal to twice the total net AC current in the trace and the current at the inner edge is equal to three times the total trace current. As the center of the spiral is approached the magnitude of the flux causing eddy currents increases along with the conduction losses. This problem is well known and is called proximity effect. The proximity effect forces AC current towards the edges of the copper foil segments and out of the interior of the copper foil segment. The proximity effect causes a large increase in AC winding resistance and an increase in conduction losses. A planar magnetic that is constructed to avoid these proximity effects has a significant performance advantage in reduced AC conduction losses and extended frequency range.

Another problem with spiral wound planar magnetics is that the area and volume of the circuit that is dedicated to providing a return path for winding currents outside of the core window is large and results in a low space utilization factor, higher winding resistance, and associated conduction losses, both DC and AC. A planar magnetic that provides a short, low volume, return path for winding currents offers a significant advantage.

OBJECTS AND ADVANTAGES

An object of the invention is to accomplish a power magnetic circuit element with low AC conduction losses when operating at high switching frequency.

Another objective is to provide a magnetic circuit element with low assembly costs.

Another object of this invention is to provide a low profile power magnetic circuit element which is suitable for very high density power conversion.

Another object of this invention is to provide a power magnetic circuit element with high product uniformity.

Another object of this invention is to provide a low profile coupled magnetic circuit element structure with high coupling coefficient, high efficiency, and low leakage inductance.

Further objects and advantages of my invention will become apparent from a consideration of the drawings and ensuing description.

These and other objects of the invention are provided by a novel construction arrangement that uses two or more separate printed wiring assemblies connected together electrically by short wires or conducting pins with at least two layers of a magnetic core material, composed, at least partially, of a ferromagnetic substance, sandwiched between and over or under the printed wire assemblies to form a four layer stacked planar magnetic structure. The windings are formed by rectangular loops of conductor which traverse at least two pins or wires and at least two sections of copper foil on at least two different printed wire assemblies. The lines of induction created by the planar currents in the foil are mostly parallel to the plane of the foil, but perpendicular to the direction of the current. Some lines of flux will be generated perpendicular to the plane of the foil but these lines of flux will largely be canceled by oppositely directed flux from current originating from the opposite direction. The skin and proximity effects force the electrical charge carriers to within one skin depth of the surface of the copper foil plane for AC currents. If the foil thickness is small by comparison to a skin depth, which can be readily accomplished, then the AC conduction losses will be nearly equal to the conduction losses for an equivalent DC current so that there is not a significant conduction loss penalty attributable to high switching frequencies as in many other planar magnetic structures.

BRIEF DESCRIPTION OF THE DRAWINGS

The present invention is illustrated by reference to the drawings in which like reference numerals refer to like elements of the invention.

FIG. 1(*a*) shows a side view of the structure. FIG. 1(*b*) shows a top view of the structure. FIG. 1(*c*) shows an end view of the structure.

FIG. 2(*a*) shows the top layer of a lower printed wiring board. FIG. 2(*b*) shows a top layer of an upper printed wiring board. FIG. 2(*c*) shows a bottom layer of a lower printed wiring board. FIG. 2(*d*) shows a bottom layer of an upper printed wiring board.

FIG. 4(*a*) shows a side view of the core portion of the structure. FIG. 4(*b*) shows a top view of the core portion of the structure. FIG. 4(*c*) shows an end view of the core portion of the structure.

FIG. 5(*a*) shows a side view of the structure. FIG. 5(*b*) shows a top view of the structure. FIG. 5(*c*) shows an end view of the structure.

Figure 1:
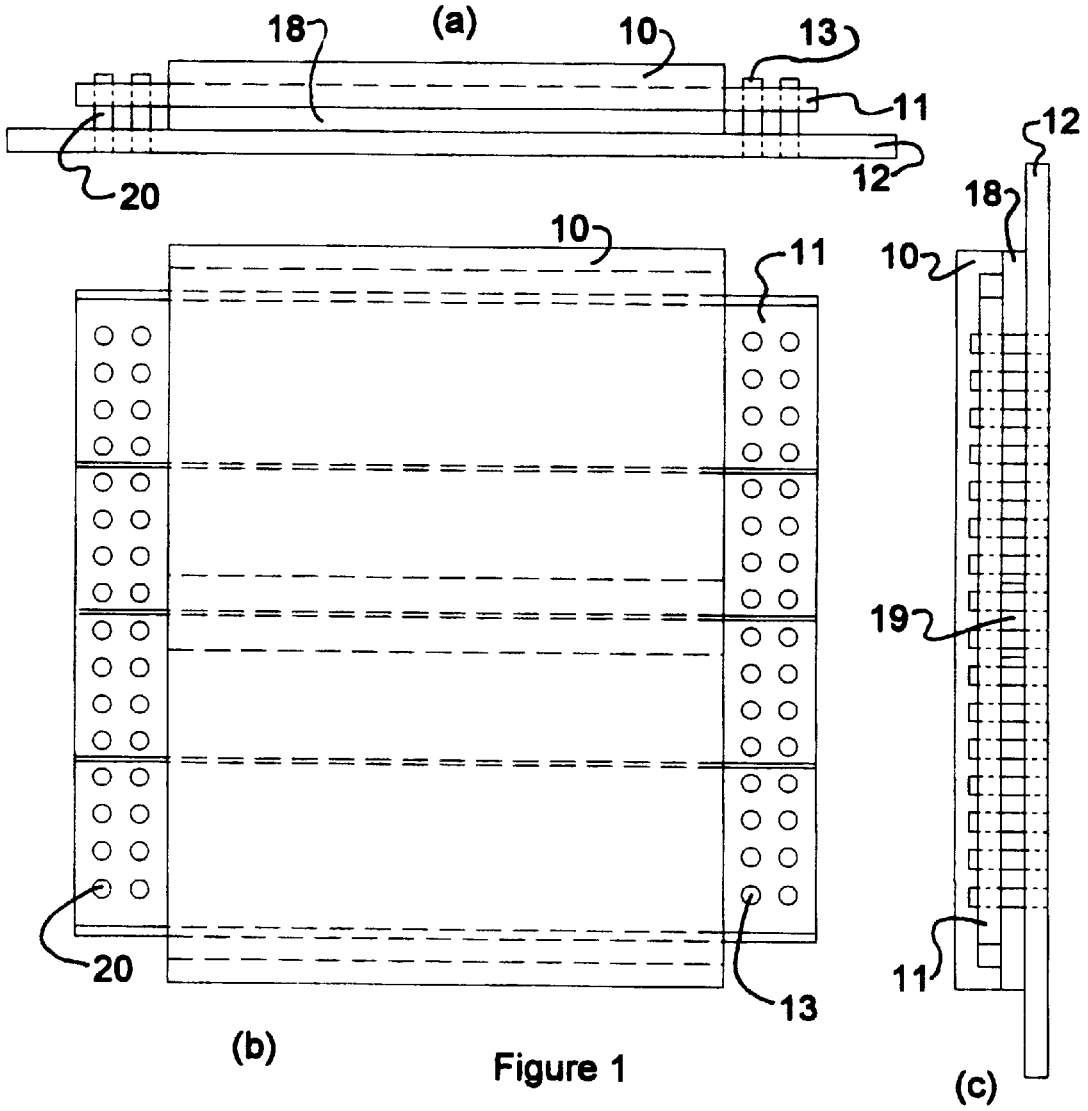
FIG. 1 is a mechanical drawing of a four layer stacked planar magnetic structure according to the subject invention.

| Reference Numerals | |
|---|---|
| 10 magnetic core piece | 11 printed wiring board |
| 12 printed wiring board | 13 pin |
| 14 copper foil | 15 copper foil |
| 16 copper foil | 17 copper foil |
| 18 magnetic core piece | 19 magnetic core piece |
| 20 pin | |

SUMMARY

The subject invention uses a unique construction arrangement consisting of at least two magnetic core pieces and at least two printed wiring boards and copper wires or pins to form a magnetic circuit element that provides a low mechanical profile, a very high power density, and a winding arrangement that yields very low AC conduction losses. The windings of the circuit element are formed by the copper foil segments on the printed wiring boards. Each full turn requires at least one copper foil segment on the upper printed wiring board, at least one copper foil segment on the lower printed wiring board and at least two pins or wires for connecting the copper foil segment(s) on the upper printed wiring board to the copper foil segment(s) on the lower printed wiring board. The new arrangement results in space savings compared to a printed winding board spiral winding construction because the windings must extend only a small fraction of the total winding width beyond the magnetic core and spiral windings extend the full width of the winding beyond the magnetic core on both ends of the core. The subject invention requires two simple printed wiring boards, but these boards do not require the expensive punching process required by a spiral winding structure to accommodate the core leg(s) and center post.

DESCRIPTION OF THE PREFERRED EMBODIMENTS

Referring to FIG. 1, there is shown a magnetic circuit element structure. The magnetic circuit element structure consists of at least two printed wiring boards, a magnetic core structure, and pins or wires for interconnecting the two printed wiring boards. Each printed wiring board has at least one copper foil segment which forms one half of a full turn. For each copper foil segment which is part of a full turn the copper foil segment is connected in series with a corresponding copper foil segment on the other printed wiring board to form the full turn.

Structure

Figure 2B:
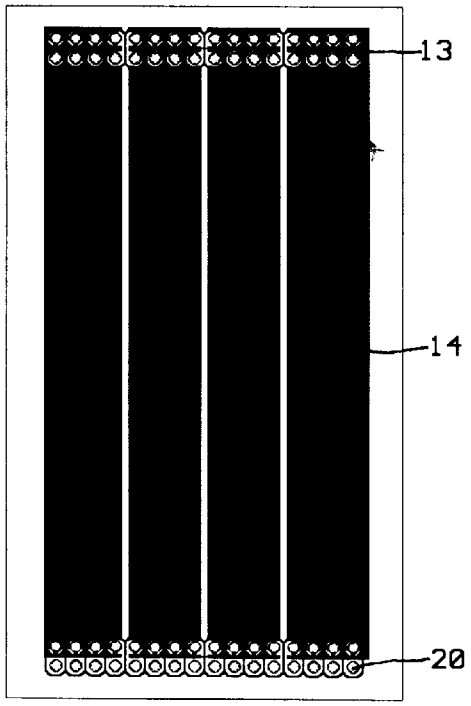
FIG. 2 illustrates how the copper foil patterns can be formed for a simple transformer using two double sided printed wiring boards.
Figure 2D:
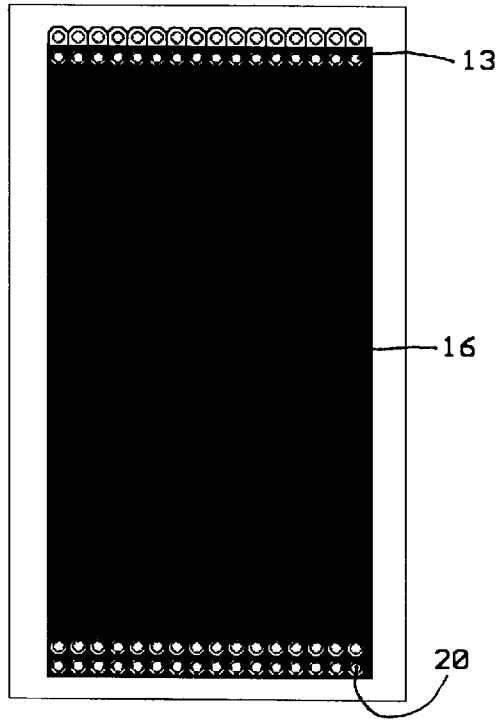
Figure 4:
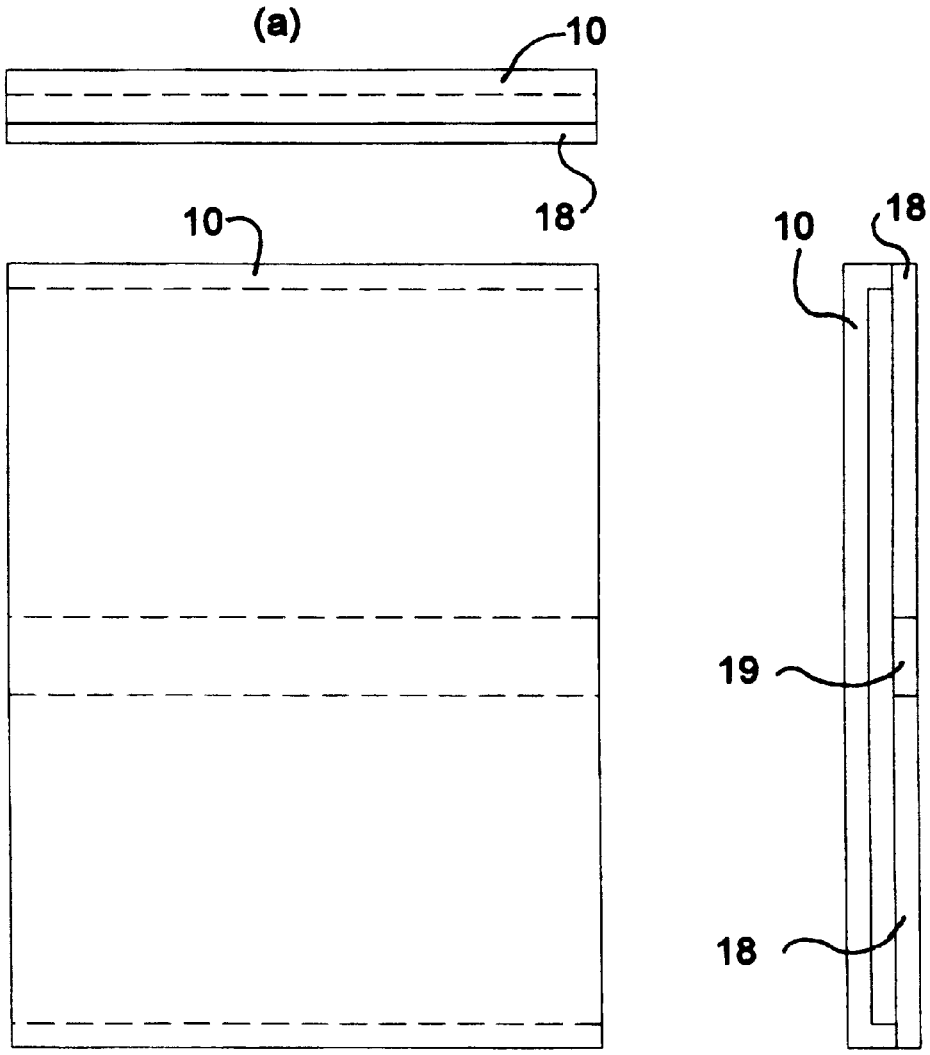
FIG. 4 is a mechanical drawing of the magnetic core portion of the FIG. 1 structure.

Referring to FIG. 1, there is a four layer stacked structure. A first layer consists of a first printed wiring board 12. A second layer, which is adjacent to and parallel to the first layer, consists of a first layer of a magnetic core structure 18, which is further illustrated in FIG. 4. A third layer, which is parallel to and adjacent to the second layer, consists of a second printed wiring board 11. A fourth layer, which is parallel to and adjacent to the third layer, consists of second layer of a magnetic core structure 10. Legs of structure 10 provide a magnetic flux path from structure 10 to structure 18 so that there is a closed magnetic flux path, provided by the combination of structure 10 and structure 18. A first pin 13 connects board 12 to a first copper foil segment 16, residing on board 11, as illustrated in FIG. 2*d*. A second pin 20 connects segment 16 to a second copper foil segment 17, residing on board 12, as illustrated in FIG. 2*c*. In the middle of structure 18 there is a spacer 19, as illustrated in FIGS. 1 and 4. Spacer 19 may have a width that ranges from zero to approximately 50 per cent of the width of structure 18. Spacer 19 may have a relative permeability that ranges between 1 and approximately 10000. Spacer 19 may provide a means for substantial magnetic energy storage, if its width is greater than zero and it is composed of a material with a substantially low magnetic permeability, such as plastic, air, or an iron powder ceramic. Alternately, spacer 19 may comprise both a material with a substantially low magnetic permeability and a permanent magnetic material that provides a DC magnetic bias to the entire core structure.

Operation

Figure 2A:
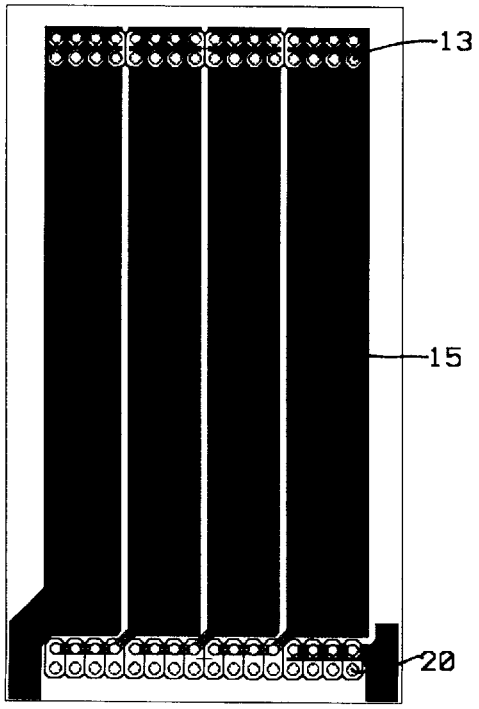
Figure 2C:
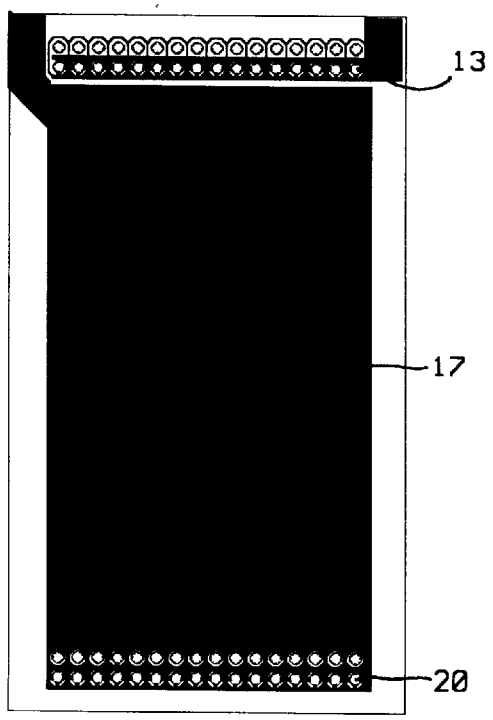
Figure 3:
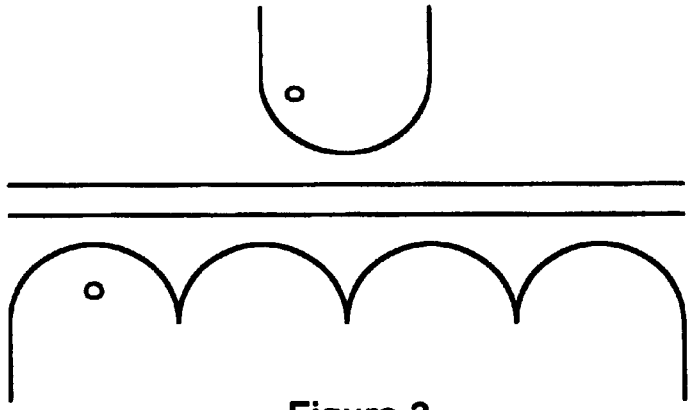
FIG. 3 illustrates an electrical schematic for the transformer of FIGS. 1 and 2.

FIG. 2*c* and 2*a* illustrate two different layers of a part of board 12, which may extend beyond the boundaries of the FIGS. 2*a* and 2*c* to accommodate other circuits. FIGS. 2*b* and 2*d* show two different layers of board 11. FIGS. 2*b* and 2*d* show all of board 11 and the boundaries, shown in the FIGS. 2*b* and 2*d*, are the boundaries of board 11. Referring to FIGS. 2*c* and 2*d*, current entering from board 12, at the upper right corner of FIG. 2*c*, passes through pin 13 to segment 16. The current passes through segment 16 from the top of FIG. 2*d* to the bottom of FIG. 2*d* and then passes through pin 20 and on to segment 17, shown in FIG. 2*c*, on board 12. The current then passes through segment 17, from the bottom of FIG. 2*c* to the top left of FIG. 2*c*, completing a full turn, and then the current passes on to other circuits that may reside on board 12, which may extend beyond the part of board 12 that is illustrated in FIG. 2*c*. The segments 16 and 17 and the pins 13 and 20 form a complete turn and a complete one turn winding. The current described above induces magnetic flux in the structures 10 and 18 and in the spacer 19. The direction of the flux can be determined from the Biot-Savart Law and is clockwise as viewed from the core cross section at the right side of FIG. 4. FIG. 2*a* illustrates a second copper layer, residing on board 12, and a part of a second winding with four turns. FIG. 2*b* illustrates a second copper layer residing on board 11. The copper foil segments and the pins connected to the copper segments, illustrated in FIGS. 2*a* and 2*b*, form the four turn winding. The entrance and exit of the current for the four turn winding are on the opposite end of the board 12 from the entrance and exit of the current for the one turn winding described above. The current in the four turn winding induces magnetic flux in the structures 10 and 18 and in the spacer 19. Alternately varying flux in the structures 10 and 18 may induce a voltage and associated current, based on Faraday's Law, in the windings. Also a varying current in one winding may induce a varying flux in the structures 10 and 18, which in turn induces a voltage and an associated current in the other winding, so that the two windings are magnetically coupled, and the windings and magnetic structures 10 and 18 function as a transformer or a coupled inductor.

Consider FIG. 2*c*. In the wide copper trace shown in FIG. 2*c* current is flowing from the bottom of the trace to the top of the trace. Consider a small strip segment of copper foil near the center of the trace and running from the top to the bottom of the trace. Let us assume that all of the current in the trace is concentrated into this small strip segment at the center of the trace. Current in this trace segment will induce flux that will be directed into the page at the right side of the trace and will induce flux that will be directed out of the page at the left side of the trace, according to the right hand rule. Eddy currents will result that will cancel this flux in the copper trace, so that counter clockwise eddy currents will be generated on the right side of the trace and clockwise eddy currents will be generated on the left side of the trace. Both of these eddy currents would result in higher currents at the left and right edges of the wide trace, and they would reduce the current at the center of the trace. We must conclude that our assumption that all of the current was confined to the center of the trace was incorrect. The current cannot flow entirely at the center of the trace. If we now assume that the currents are confined to the two outer edges of the trace, then the net flux will cancel at the center of the trace, but as we approach the right edge of the trace the effect of the current on the right edge is greater than the effect of the current on the left edge, due to the proximity to the current on the right, and the flux in the foil on the right side of the trace, induced by the edge currents, will be directed up and out of the page, and the eddy current needed to cancel this flux will be directed so as to increase the current at the center of the trace and decrease, or cancel, the current at the edge of the trace. Similarly a consideration of the situation on the left side of the trace would determine that the eddy currents, resulting from the fields generated by the edge currents, would increase the current at the center of the trace and decrease the current at the edge of the trace. This result would contradict our assumption that the currents are confined to the edges of the trace. In summary, the effect of current at the center of the trace is eddy currents that force the current to the left and right side edges of the trace, and the effect of currents at the edges of the trace is eddy currents that reduce the current at the edges of the trace and force the current to the center of the trace. These results seem contradictory, which leads us to the conclusion that both of our assumptions are wrong, and that current is neither concentrated at the center of the trace nor at the edges of the trace, but is distributed evenly across the entire surface of the trace. These results are confirmed in practice and understood by those skilled in the art of high frequency magnetic circuit element design.

Additional Embodiments

Figure 5:
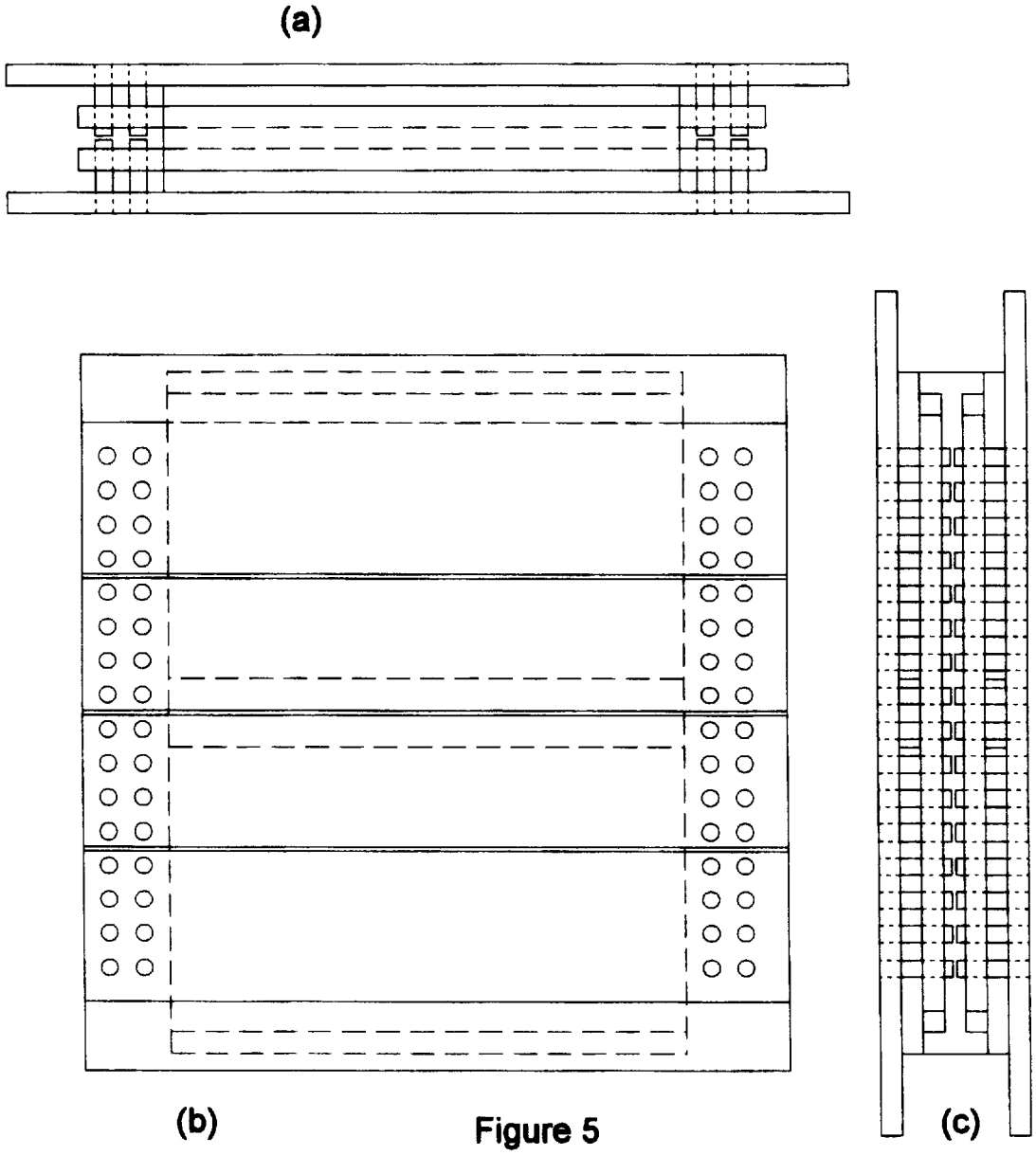
FIG. 5 is a mechanical drawing of a seven layer stacked planar magnetic structure according to the subject invention.

Another embodiment can be realized, as illustrated in FIG. 5, by adding two more printed wiring board layers and one more magnetic core layer, stacked on top of the four existing stacked layers, whereby a second independent upper magnetic circuit element is formed, in which structure 10, now H shaped rather than U shaped, is shared, by both the upper and lower magnetic circuit elements, as a path for return magnetic flux for both upper and lower magnetic circuit elements. If the return flux in structure 10 for the upper magnetic circuit element is opposite in direction to, but nearly equal in value to, the return flux in structure 10, provided by the lower magnetic circuit element, then the layer thickness of structure 10 may be reduced, considering core loss energy, temperature, and saturation limitations.

Additional embodiments are realized by adding or deleting copper layers and windings to the boards 11 and 12. Although only two copper layers are illustrated in the figures, more copper layers and more windings can be added, or one of the copper layers and one of the windings can be deleted. Additional embodiments are added by moving the spacer to one of the three other core segments.

Conclusion, Ramifications, and Scope of Invention

Thus the reader will see that the magnetic circuit element structure of the invention provides a novel and unique planar magnetic circuit element with low assembly cost, high power volume density, and low AC conduction losses.

While my above description contains many specificities, these should not be construed as limitations on the scope of the invention, but rather as exemplifications of preferred embodiments thereof. Many other variations are possible. For example, other variations include structures with more than two windings and more than two printed wiring board winding layers and integrated structures, as illustrated in FIG. 5, with more than two printed wiring boards and more than two magnetic core layers.

Accordingly, the scope of the invention should be determined not by the embodiments illustrated, but by the appended claims and their legal equivalents.

I claim:

1. A planar interleaved stacked layer magnetic circuit element structure comprising:

a first printed circuit layer containing copper used to form a part of a winding turn, a first magnetic core layer, placed adjacent to and parallel to said first printed circuit layer, a second printed circuit layer containing copper used to form another part of said winding turn placed adjacent to and parallel to said first magnetic core layer, a second magnetic core layer, placed adjacent to and parallel to said second printed circuit layer, legs consisting of a magnetic core material, for magnetically coupling said first magnetic core layer to said second magnetic core layer, thereby forming a loop of magnetic core around said second printed circuit layer, electrical conducting means for electrically connecting said first printed circuit layer to said second printed circuit layer to complete said winding turn, whereby said first and second magnetic core layers, together with said legs, form a magnetic core structure, and said first and second printed circuit layers, together with said electrically conducting means, form an electrically conductive winding for carrying electrical current that induces magnetic flux in said magnetic core structure, and said magnetic core structure together with said electrically conductive winding forms a planar interleaved stacked layer magnetic circuit element structure with the benefits of high space efficiency and low AC winding losses.

2. A planar interleaved stacked layer magnetic circuit element structure as set forth in claim 1 wherein said first or said second or both said first and said second printed circuit layers comprise multi-layer printed circuit boards.

3. A planar interleaved stacked layer magnetic circuit element structure as set forth in claim 1, wherein said first and second printed circuit layer and said electrically conducting means comprise an electrical circuit winding that comprises more than one winding turn.

4. A planar interleaved stacked layer magnetic circuit element structure as set forth in claim 3, wherein said first and second printed circuit layers and said electrically conducting means comprise an electrical circuit that consists of more than one winding.

* * * * *